US006484992B1

(12) United States Patent
Svensson et al.

(10) Patent No.: US 6,484,992 B1
(45) Date of Patent: Nov. 26, 2002

(54) DEVICE FOR A FLAG

(76) Inventors: Leif Svensson, PL 7894, SE-444 93, Spekeröd (SE); Mats Svensson, PL 7894, SE-444 93, Spekeröd (SE)

( * ) Notice: Subject to any disclaimer, the term of this patent is extended or adjusted under 35 U.S.C. 154(b) by 0 days.

(21) Appl. No.: 09/674,319

(22) PCT Filed: May 20, 1999

(86) PCT No.: PCT/SE99/00865

§ 371 (c)(1),
(2), (4) Date: Oct. 25, 2000

(87) PCT Pub. No.: WO99/60232

PCT Pub. Date: Nov. 25, 1999

(30) Foreign Application Priority Data

May 20, 1998 (SE) ..... 9801801

(51) Int. Cl.[7] ..... A47H 1/10

(52) U.S. Cl. ..... 248/320; 116/173; 116/174; 248/297.11

(58) Field of Search ..... 248/320, 323, 248/325, 329, 331, 332, 231.41, 230.1, 219.2, 219.4, 218.4, 157, 520–523, 317, 297.11; 116/173, 174; 40/591, 604, 607, 601

(56) References Cited

U.S. PATENT DOCUMENTS 2,368,783 A * 2/1945 Schillinger ..... 116/174
3,686,498 A * 8/1972 Meyer ..... 248/320 X
3,923,001 A * 12/1975 Murdock ..... 116/173
3,958,116 A * 5/1976 Jones ..... 362/401
4,603,652 A * 8/1986 Thibault et al. ..... 116/174
4,850,558 A * 7/1989 Leschot ..... 248/297.1
5,168,828 A * 12/1992 Smyly, Sr. ..... 116/173

FOREIGN PATENT DOCUMENTS

DE 3010029 9/1981
DE 4141688 * 6/1993

* cited by examiner

*Primary Examiner*—Leslie A. Braun
*Assistant Examiner*—Tan Le
(74) *Attorney, Agent, or Firm*—Orum & Roth

(57) ABSTRACT

An arrangement for a flag pole which exhibits, extending along the outside of the flag pole, a raisable holder for a flag, standard, banner or similar, whereby a line is so arranged and attached to the aforementioned flag holder as to run over a line deflector pulley situated at the top of the flag pole and down to the ground. The flag holder and a number of mast track slides and a counterweight are so arranged as to be guided by a guide extending in the longitudinal sense of the flag pole on the outside thereof, and a flag, etc., is so arranged as to be detachably attached to the aforementioned guided moving parts. In addition guide runners, which are pivotally mounted and capable of lateral movement to a certain extent, are attached to the flag holder.

20 Claims, 6 Drawing Sheets

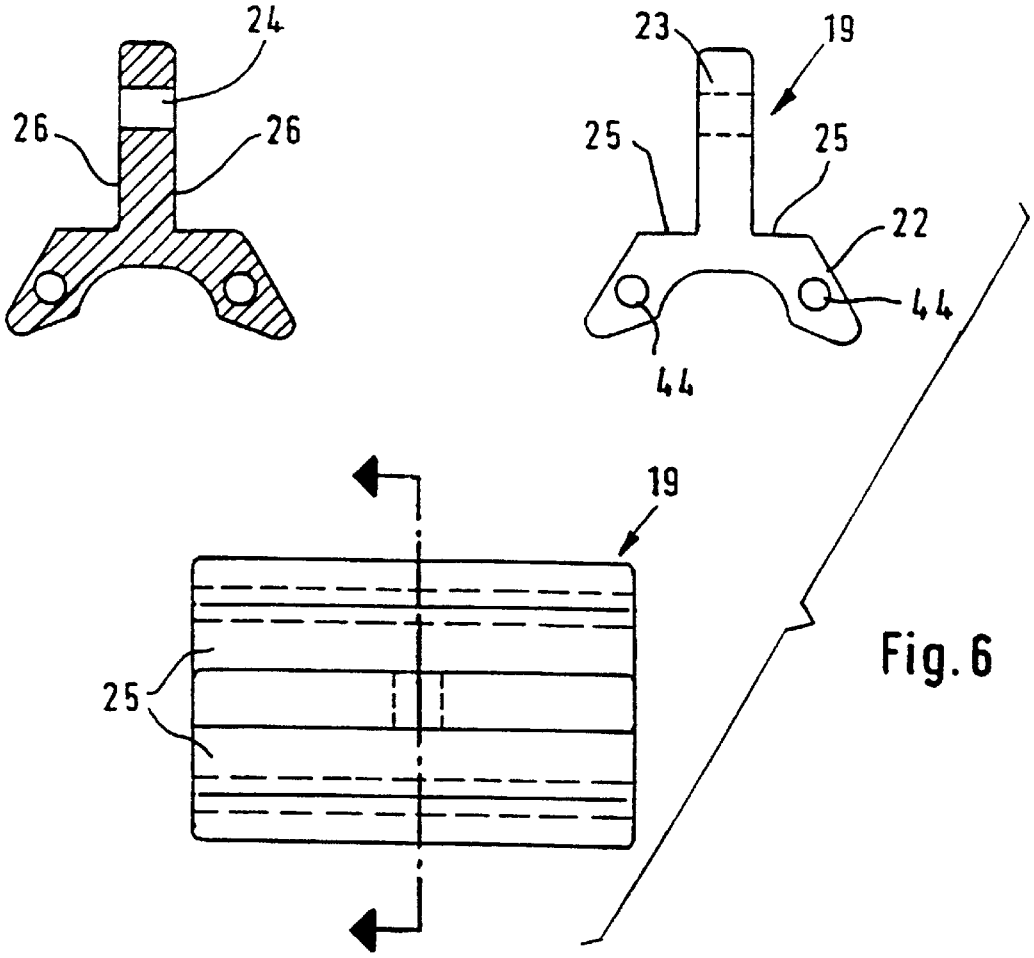
Fig. 6
Fig. 7
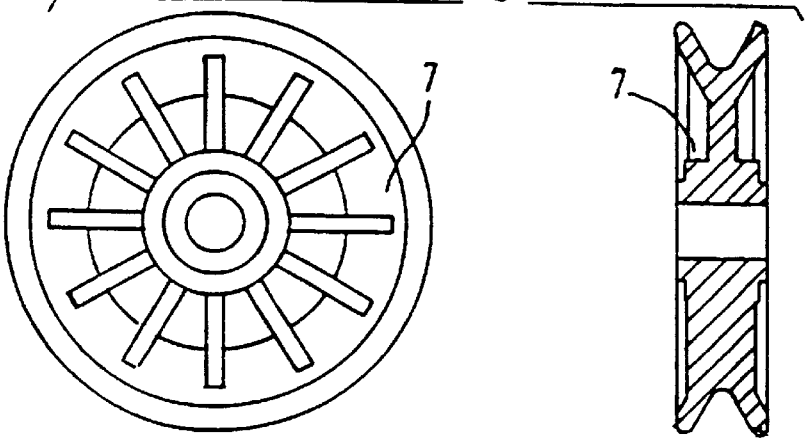

DEVICE FOR A FLAG

The present invention relates to an arrangement for a flag pole which exhibits, extending along the outside of the flag pole, a raisable holder for a flag, standard, banner or similar, whereby a line is so arranged and attached to the aforementioned flag holder as to run over a line deflector pulley situated at the top of the flag pole and down to the ground, in conjunction with which the flag holder and a number of mast track slides and a counterweight are so arranged as to be guided by a guide extending in the longitudinal sense of the flag pole on the outside thereof, and a flag, etc., is so arranged as to be detachably attached to the aforementioned guided moving parts, and the flag holder is formed by a metal profile rod, at the upper part of which an attachment upright for a flag hanging rod is supported extending perpendicularly outwards from the pole.

Previously described arrangements for this purpose are complicated and not all that durable, because the flag in this case is affected by significant forces, especially when the wind is blowing strongly.

Previously disclosed through DE 4,141,688 A1 is a flag holder arrangement comprising a profile rail capable of attachment along the outside of a flag pole. An attachment rail for a standard is capable of being accommodated in this rail, and a number of attachments for the standard are distributed along this attachment rail. The attachments, which are formed from attachment rings, are screwed securely in place so as to extend perpendicularly outwards from the rail and thus from the flag pole. The disadvantage of this previously disclosed design is that the attachment rail is guided directly in the profile rail, and that the risk is considerable that the attachment rail cannot slide easily and be displaced internally in the profile rail, for example when the wind imposes stresses on the standard. Inclination of the rail is thus not permitted to any major degree.

Also previously disclosed through DE 3,010,029 A1 is a flag holder arrangement in which a standard is held by means of a number of standard holder guide devices capable of being accommodated in a guide groove integrated with the flag pole.

These devices are held together with a line at a mutual distance from one another. Attachments for standards are rigidly attached to these standard holder guide devices designed as sliding pieces. The risk is also present in this previously disclosed holder arrangement of the devices becoming trapped, for example when they are placed under an uneven load.

The principal object of the present invention is thus, in the first instance, to solve the aforementioned problems and to function reliably.

The aforementioned object is achieved by means of an arrangement in accordance with the present invention, which is characterized essentially in that a number of pivotally mounted guide runners are attached to the holder rod at a mutual distance from one another and are accommodated in such a way that they are guided by the guide via a number of horizontal bearing shafts which extend across the aforementioned flag attachment uprights and the flag hanging rod.

The invention is described below as a preferred illustrative embodiment, in conjunction with which reference is made to the accompanying drawings, in which FIG. 1 shows the arrangement in accordance with the invention and it constituent parts;

FIG. 6 shows a guide runner which is a part of the flag holder as a sectioned view and from the end and from above;

FIG. 7 shows a top pulley which is a part of the top part; and

Figure 1:
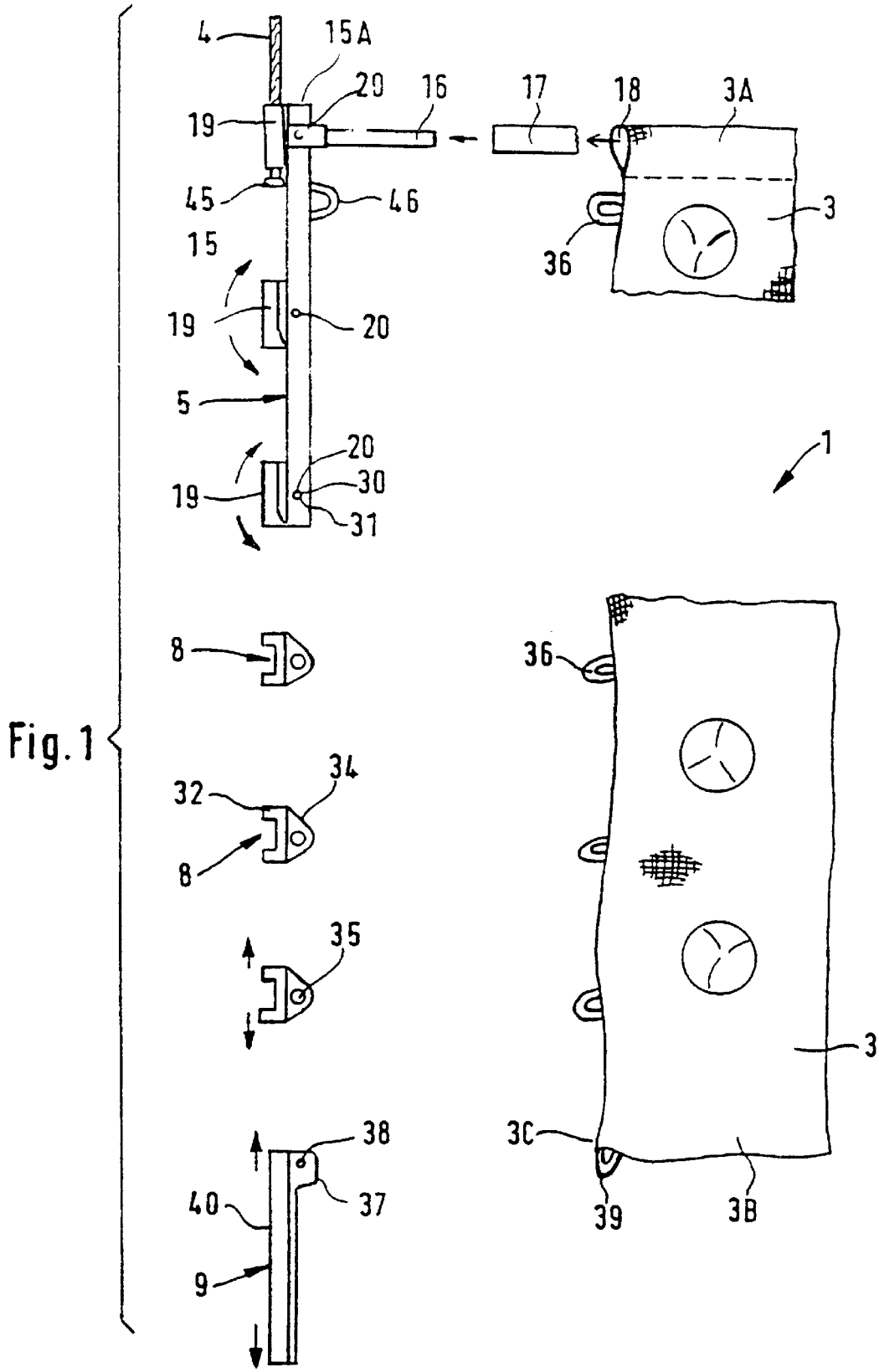
Figure 2:
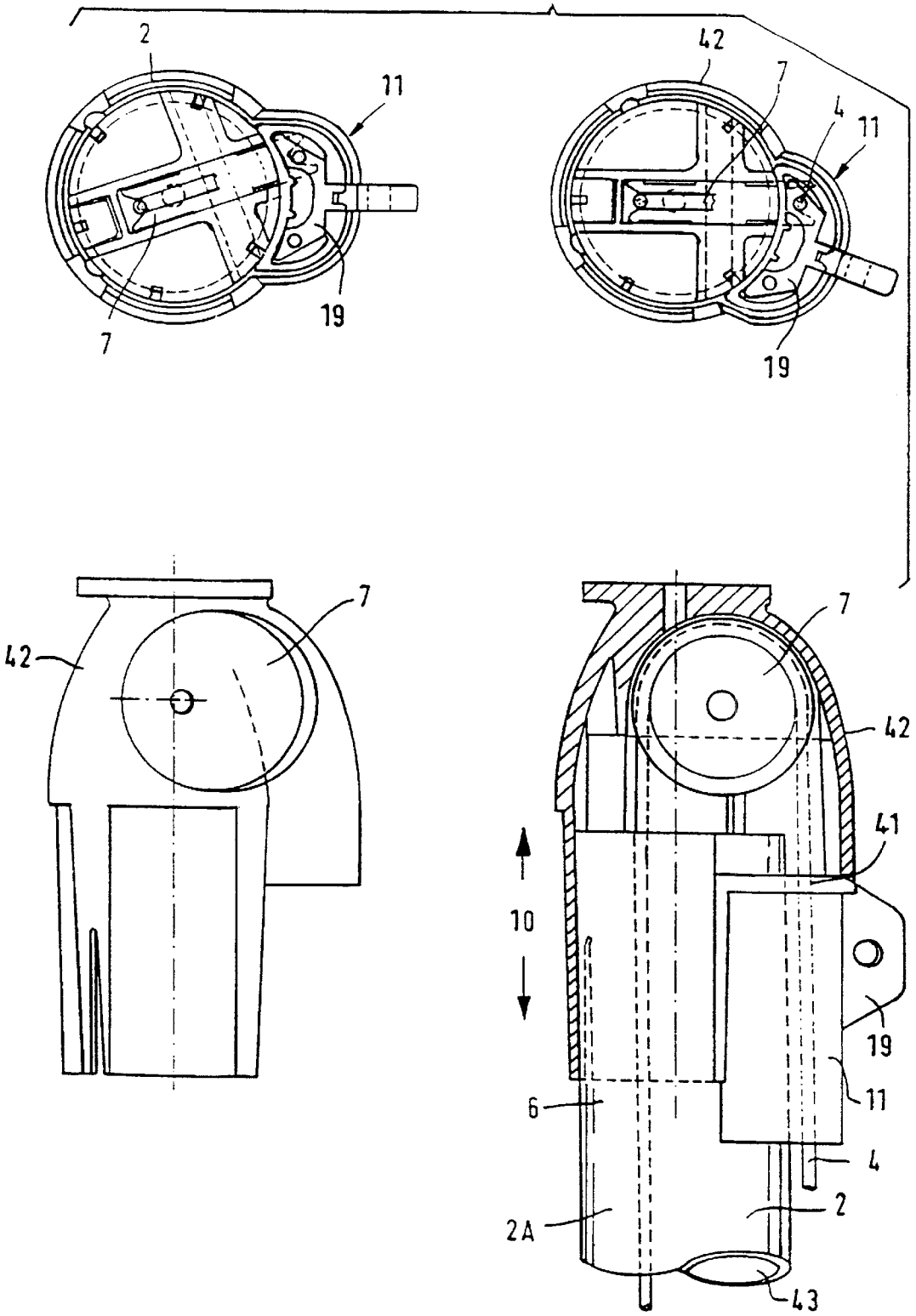
FIG. 2 shows the upper end of a flag pole and a top part placed on it viewed from the side and from above.
Figure 3:
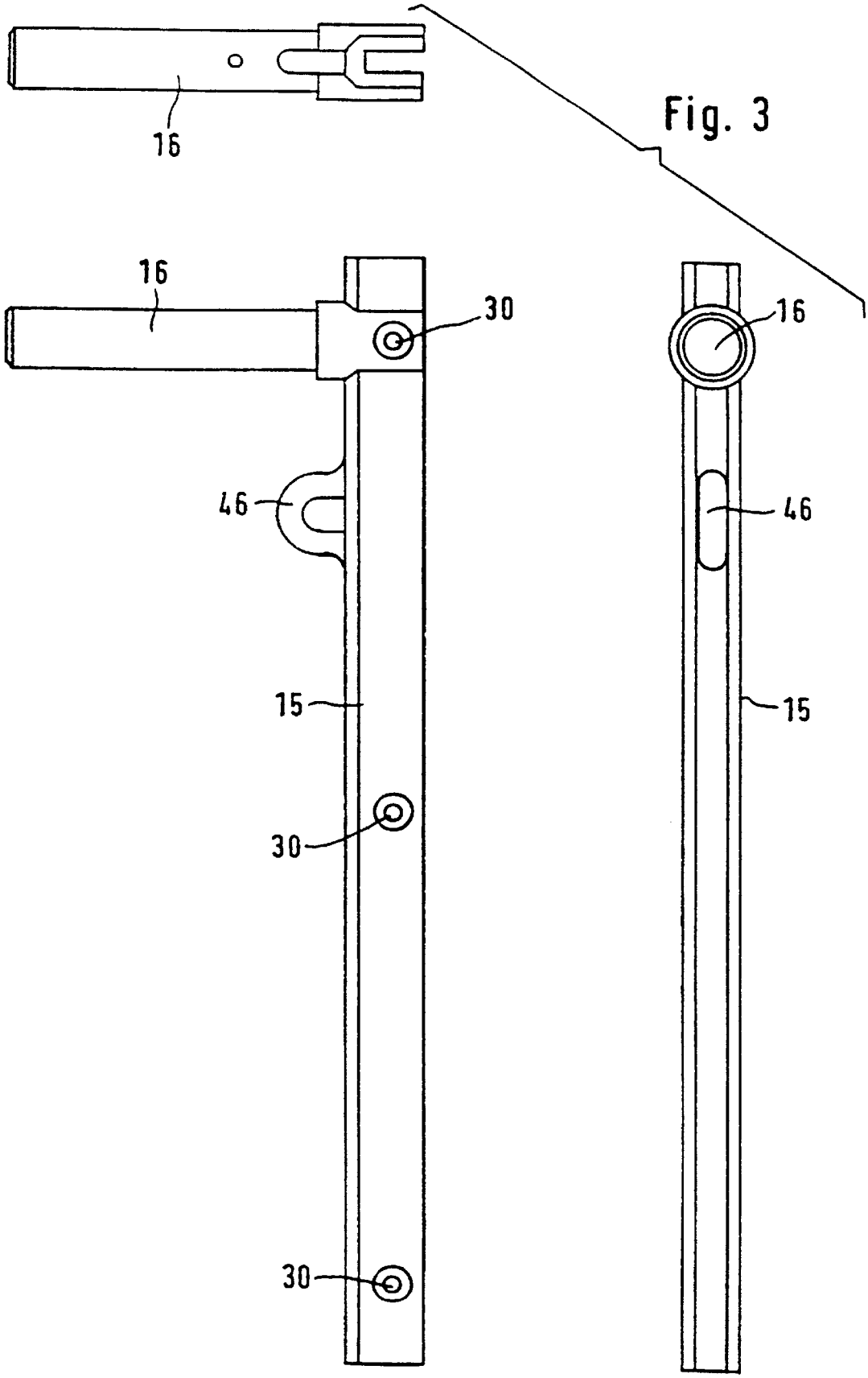
FIG. 3 shows different views of the flag holder.
Figure 4:
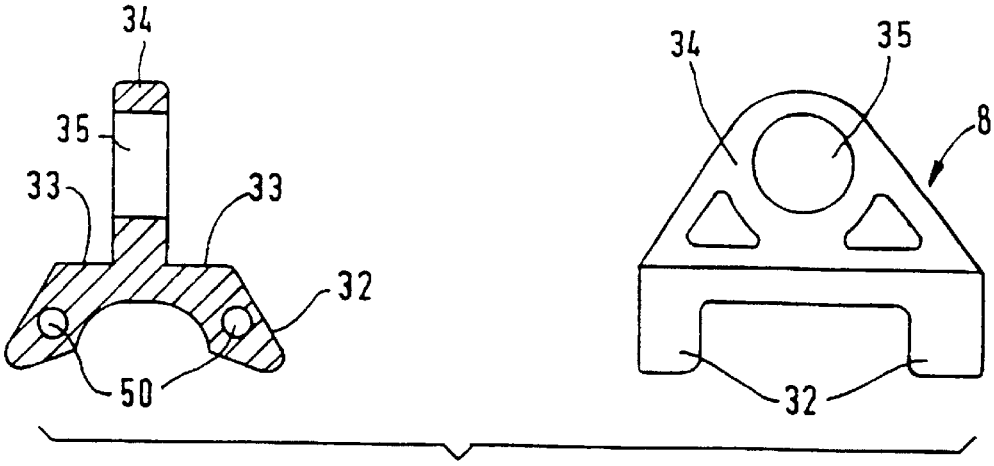
FIG. 4 shows track slides viewed from the end and from the side.
Figure 5:
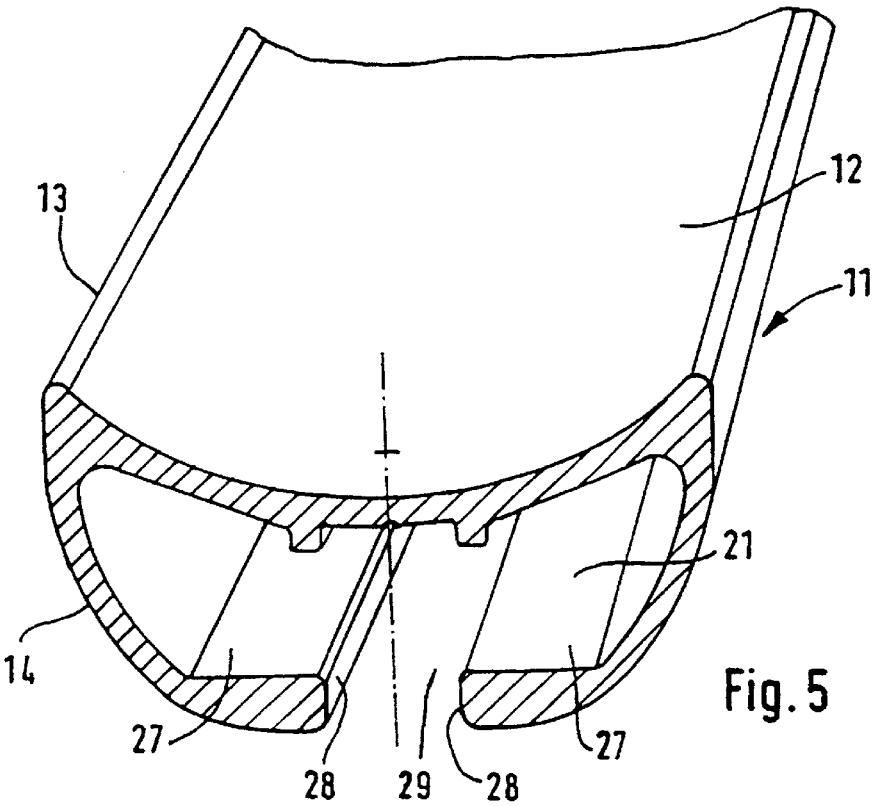
FIG. 5 shows part of a guide.
Figure 8:
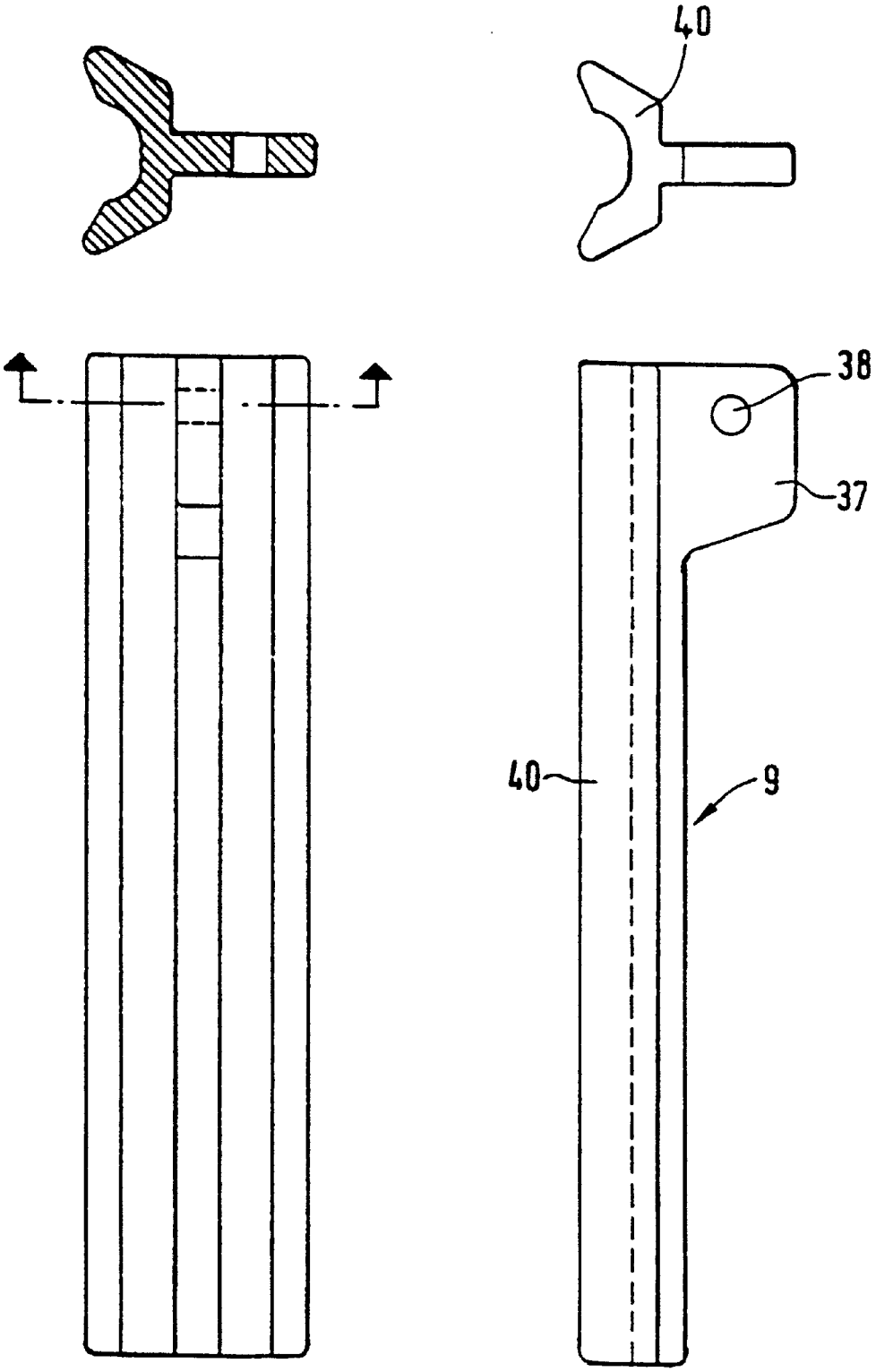
FIG. 8 shows a counterweight as a sectioned view and from above, from the end and from the side.

An arrangement 1 of the kind intended by the present invention comprises, extending along the outside 2A of a preferably hollow flag pole 2, a raisable holder 5 for a flag 3, standard, banner or similar. A line 4 is so arranged and attached to the aforementioned flag holder 5 as to run over a line deflector pulley 7 situated at the top 6 of the flag pole and down to the ground. More specifically, the flag holder 5 and a number of mast track slides 8 and a counterweight 9 are so arranged as to be guided by a guide 11 extending in the longitudinal sense 10 of the flag pole and attached to the pole 2 on its outside 2A. In conjunction with this, a flag 3, etc., is so arranged as to be detachably attached to the aforementioned guided moving parts 5, 8, 9.

The guide 11 in this case is in the form of a hollow profile of extruded aluminium, the outside 12 of which is adapted in its form along one part 13 to fit the outside 2A of the flag pole in question and is so arranged as to be attached to the flag pole 2 preferably by means of screws or pop rivets, etc.

The remaining part 14 of the guide 11 connects the flag pole to the guide 11 past the aforementioned shaped outside 12 of the guide 11.

The aforementioned flag holder 5 is in the form of a metal profile rod 15, in the upper part 15A of which a short attachment upright 16 extending perpendicularly outwards from the pole 15 is present, and on which a flag hanging rod 17, which can be threaded on and securely screwed in place, is so arranged as to be supported. The aforementioned flag hanging rod 17, which extends along the entire upper edge 3A of a flag 3, is intended to be accommodated inside a channel 18 in the flag 3.

A number of guide runners 19 made of a plastic material pivotally mounted around horizontal bearing shafts 20, which extend across the aforementioned flag attachment upright 16 and the flag hanging rod, are attached to the holder rod 15 at a mutual distance from one another and are accommodated in such a way as to be guided by the guide 11. In this way the aforementioned guide runner 19 is formed by an accommodating part 22 shaped to fit the guide 11 and its internal accommodating space 21, which is provided with a projecting bearing part 23 extending in a direction outwards from it, in which a bearing opening 24 is present. Arranged between the accommodating part 22 and the bearing part 23 are perpendicular sliding surfaces 25, 26, against which internal contact surfaces 27, 28 in the guide 11 are so arranged as to lie on either side of an elongated slot 29 in the guide 11.

Each guide runner 19 is pivotally mounted on the holder rod 15 via a screw 31 screwed into a threaded hole 30 in the holder rod 15.

Mast track slides 8, made of a suitable plastic material, are also so arranged as to be accommodated with one part 32 in the hollow accommodating space 21 in the guide 11, so as to be guided by it and retained by plane surfaces 27, 33 acting against one another in pairs. A projecting opposing part 34 of the mast track slide 8 is capable of attachment to the flag 3, etc., preferably by means of tapes or similar attachment devices accommodated in holes 35 or loops 36 in the mast track slide 8 and the flag 3.

The counterweight 9, which is in the form of a weight made of a metal material provided at one end with a fixing lug 37 with an opening 38 for attachment to the lower inner end 3B of a flag 3 to an attachment loop 39 situated in its corner 3C, has on its opposite side a part 40 shaped to fit the guide 11 and its inner accommodating space 21.

The flag holder 15 has its upper guide runner 19 arranged on a level with the upper end 15A of the holder rod 15, and the aforementioned upper guide runner 19 is so arranged as to be accommodated in a recess 41 in a top part 42 capable of being threaded onto the upper part 6 of the hollow flag pole, which top part exhibits a top pulley 7 rotatably mounted therein for deflecting the hoisting line 4 for the flag 3 so that it passes downwards internally in the inner cavity 43 of the flag pole.

The hoisting line 4 is preferably threaded through a lateral hole 44 in the upper guide runner 19 and is locked in place with a line lock 45, although if preferred the line 4 can also be drawn through holes 50 situated in a line in the mast track slides 8.

The function and interaction of the invention should have been appreciated from the above description and from the drawings. Mention must also be made of the ability to connect an upper attachment loop 46 in the holder rod 15 by means of attachment devices to an upper attachment loop 36 on the flag 3.

The invention is not restricted to the illustrative embodiments described above and illustrated in the drawings, but may be modified within the scope of the Patent Claims without departing from the idea of invention.

What is claimed is:

1. A flag pole (2) which exhibits, extending along the outside (2A) of the flag pole (2), a raisable holder (5), whereby a line (4) is attached to the flag holder (5) running over a line deflector pulley (7) situated at the top of the flag pole and down to the ground, in conjunction with which the flag holder (5) and a number of mast track slides (8) and a counterweight (9) are guided by a guide (11) extending in the longitudinal sense (10) of the flag pole on the outside (2A) thereof, and a flag (3), is detachably attached to the guided moving parts (5,8,9) flag holder (5), and the flag holder (5) is a formed by a metal profile rod (15), at an upper part (15A) of which an attachment upright (16) for a flag hanging rod (17) is supported extending perpendicularly outwards from the pole (15), characterized in that a plurality of pivotally mounted guide runners (19) are attached to the holder rod (15) at a mutual distance from one another and are guided by the guide (11) via a plurality of horizontal bearing shafts (20) which extend across the flag attachment uprights (16) and the flag hanging rod (17).

2. A flag pole in accordance with Patent claim 1, characterized in that the guide (11) is in the form of a hollow profile, the outside (12) of which is adapted in its form to fit the outside (2A) of the flag pole along one part (13) and is attachable to the flag pole (2).

3. A flag pole in accordance with claim 1 guide runner (19) is formed by an accommodating part (22) shaped to fit the guide (11) with a projecting bearing part (23) extending outwards from it.

4. A flag pole in accordance with claim 1, characterized in that arranged between the accommodating part (22) and the bearing part (23) are perpendicular sliding surfaces (25, 26), against which internal contact surfaces (27, 28) in the guide (11) lie.

5. A flag pole in accordance with claim 1, characterized in that the guide runner (19) is pivotally mounted via a screw (31) screwed into the holder rod (15).

6. A flag pole in accordance with claim 1, characterized in that the mast track slides (8) are arranged to be accommodated with one part (32) in the guide (11) and with an opposing part (34) capable of attachment to the flag (3) by means for attachment.

7. A flag pole in accordance with claim 1, characterized in that the counterweight (9) is in the form of a weight provided at one end with a fixing lug (37) for attachment to the lower inner end (3B) of the flag (3) and a part (40) shaped to fit the guide (11) for accommodation in the inner accommodating space (21) of the guide.

8. A flag pole in accordance with claim 1, characterized in that the flag holder (15) has its upper guide runner (19) arranged on a level with the upper end (15A) of the holder rod (15), and the upper guide runner (19) is arranged as to be accommodated in a recess (41) in a top part (42) capable of being threaded onto the upper part (6) of the hollow flag pole, which top part exhibits a top pulley (7) rotatably mounted therein for deflecting the hoisting line (4) for the flag (3) so that it passes downwards internally in the inner cavity (43) of the flag pole.

9. A flag pole in accordance with claim 1, characterized in that the guide runners (19) are made from a plastic material.

10. A flag pole in accordance with claim 2, characterized in that the guide runner (19) is formed by an accommodating part (22) shaped to fit the guide (11) with a projecting bearing part (23) extending outwards from it.

11. A flag, pole in accordance with claim 2, characterized in that arranged between the accommodating part (22) and the bearing part (23) are perpendicular sliding surfaces (25, 26), against which internal contact surfaces (27, 28) in the guide (11) are so arranged as to lie.

12. A flag pole in accordance with claim 2, characterized in that the guide runner (19) is pivotally mounted via a screw (31) screwed into the holder rod (15).

13. A flagpole in accordance with claim 2, characterized in that the mast track slides (8) are arranged to be accommodated with one part (32) in the guide (11), and with an opposing part (34) capable of attachment to the flag (3) by means for attachment.

14. A flag pole in accordance with claim 2, characterized in that the counterweight (9) is in the form of a weight provided at one end with a fixing lug (37) for attachment to the lower inner end (3B) of the flag (3) and a part (40) shaped to fit the guide (11) for accommodation in the inner accommodating space (21) of the guide.

15. A flag pole in accordance with claim 2, characterized in that the flag holder (15) has its upper guide runner (19) arranged on a level with the upper end (15A) of the holder rod (15), and the upper guide runner (19) is arranged as to be accommodated in a recess (41) in a top part (42) capable of being threaded onto the upper part (6) of the hollow flag pole, which top part exhibits a top pulley (7) rotatably mounted therein for deflecting the hoisting line (4) for the flag (3) so that it passes downwards internally in the inner cavity (43) of the flag pole.

16. A flag pole in accordance with claim 2, characterized in that the guide runners (19) are made from a plastic material.

17. A flag pole in accordance with claim 3, characterized in that arranged between the accommodating part (22) and the bearing part (23) are perpendicular sliding surfaces (25, 26), against which internal contact surfaces (27, 28) in the guide (11).

18. A flag pole in accordance with claim 3, characterized in that the guide runner (19) is pivotally mounted via a screw (31) screwed into the holder rod (15).

19. A flag pole in accordance with claim 3, characterized in that the mast track slides (8) are arranged to be accommodated with one part (32) in the guide (11), and with an opposing part (34) capable of attachment to the flag (3) by means for attachment.

20. A flag pole In accordance with claim 3, characterized in that the counterweight (9) is in the form of a weight provided at one end with a fixing lug (37) for attachment to the lower inner end (3B) of the flag (3) and a part (40) shaped to fit the guide (11) for accommodation in the inner accommodating space (21) of the guide.

* * * * *